US011244603B1

(12) United States Patent
Wang et al.

(10) Patent No.: US 11,244,603 B1
(45) Date of Patent: Feb. 8, 2022

(54) LIGHT-EMITTING PANEL, AND DRIVING METHOD AND FABRICATING METHOD THEREOF, AND DISPLAY DEVICE

(71) Applicant: Shanghai Tianma Micro-Electronics Co., Ltd., Shanghai (CN)

(72) Inventors: Lihua Wang, Shanghai (CN); Xiaoping Sun, Shanghai (CN); Conghua Ma, Shanghai (CN); Qiang Dong, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 17/103,079

(22) Filed: Nov. 24, 2020

(30) Foreign Application Priority Data

Aug. 27, 2020 (CN) ..... 202010876661.6

(51) Int. Cl.
*G09G 3/32* (2016.01)
*G09G 3/20* (2006.01)

(52) U.S. Cl.
CPC ..... *G09G 3/32* (2013.01); *G09G 3/2092* (2013.01); *G09G 2300/0408* (2013.01); *G09G 2310/027* (2013.01); *G09G 2310/0278* (2013.01)

(58) Field of Classification Search
CPC ..... G09G 3/32; G09G 2310/0278; G09G 2310/027; G09G 2300/0408; G09G 3/2092
See application file for complete search history.

(56) References Cited

U.S. PATENT DOCUMENTS

2006/0202913 A1* 9/2006 Hayafuji ..... G09G 3/3233 345/44
2010/0328301 A1* 12/2010 Kim ..... G09G 3/3233 345/214
2019/0335553 A1* 10/2019 Ahmed ..... G02B 3/0018
2021/0166627 A1* 6/2021 Xiao ..... G09G 3/3233

FOREIGN PATENT DOCUMENTS

CN 108877645 A 11/2018
CN 109036283 A 12/2018
CN 111445842 A 7/2020
CN 111540764 A 8/2020

* cited by examiner

*Primary Examiner* — Muhammad N Edun
(74) *Attorney, Agent, or Firm* — Anova Law Group, PLLC

(57) ABSTRACT

Light-emitting panel, driving method, fabricating method, and display device are provided. The light-emitting panel includes a plurality of light-emitting units arranged in an array. Each light-emitting unit includes a light-emission control module and at least one light-emitting element. The at least one light-emitting element is electrically connected to the light-emission control module. The light-emitting panel also includes a plurality of data lines arranged in a first direction. Each data line is electrically connected to light-emission control modules of light-emitting units that are arranged in a second direction. The second direction intersects the first direction. The light-emitting panel also includes a plurality of scan lines arranged in the second direction. Each scan line of the plurality of scan lines is electrically connected to light-emission control modules of light-emitting units that are arranged in the first direction. The light-emitting panel also includes a first power line and a second power line.

19 Claims, 10 Drawing Sheets

100

LIGHT-EMITTING PANEL, AND DRIVING METHOD AND FABRICATING METHOD THEREOF, AND DISPLAY DEVICE

CROSS-REFERENCE TO RELATED APPLICATION

This application claims priority of Chinese Patent Application No. 202010876661.6, filed on Aug. 27, 2020, the entire content of which is hereby incorporated by reference.

FIELD OF THE DISCLOSURE

The present disclosure generally relates to the field of display technology and, more particularly, relates to a light-emitting panel, a driving method and a fabricating method of the light-emitting panel, and a display device.

BACKGROUND

A flat-panel display device in a current mainstream usually includes a light-emitting panel. The light-emitting panel may be used to generate backlight, or directly used to display an image. The light-emitting panel usually includes a plurality of light-emitting diodes (LEDs). In a display device, regional brightness control of LEDs on a light-emitting panel has been proposed, such that regional dimming may be realized.

In an existing light-emitting panel that may perform regional brightness control, the number of signal lines may be large, and wiring may be complicated. The disclosed structures and methods are directed to solve one or more problems set forth above and other problems in the art.

SUMMARY

One aspect of the present disclosure includes a light-emitting panel. The light-emitting panel includes a plurality of light-emitting units arranged in an array. Each of the plurality of light-emitting units includes a light-emission control module and at least one light-emitting element. The at least one light-emitting element is electrically connected to the light-emission control module. The light-emitting panel also includes a plurality of data lines arranged in a first direction. Each of the plurality of data lines is electrically connected to light-emission control modules of light-emitting units that are arranged in a second direction. The second direction intersects the first direction. The light-emitting panel also includes a plurality of scan lines arranged in the second direction. Each of the plurality of scan lines is electrically connected to light-emission control modules of light-emitting units that are arranged in the first direction. The light-emitting panel also includes a first power line and a second power line. The at least one light-emitting element of each light-emitting unit is electrically connected between the first power line and the second power line. The light-emission control module includes a first transistor and a second transistor. A first terminal of the first transistor is electrically connected to the data line, a second terminal of the first transistor is electrically connected to a control terminal of the second transistor, and a control terminal of the first transistor is electrically connected to the scan line. A first terminal of the second transistor is electrically connected to one of the first power line and the second power line, and a second terminal of the second transistor is electrically connected to the at least one light-emitting element. The light-emission control module receives a data signal through the data line, and the data signal is a pulse width modulation signal.

Another aspect of the present disclosure includes a fabricating method of a light-emitting panel. The fabricating method includes providing a substrate, a first transistor, a second transistor, and a light-emitting element, and forming at least one wire layer and a bonding layer on the substrate, thereby forming a circuit layer. The bonding layer includes a bonding pad electrically connected to the at least one wire layer. Forming the circuit layer includes forming a plurality of data lines, a plurality of scan lines, a first power line, and a second power line. The fabricating method also includes electrically connecting the light-emitting element, the first transistor, and the second transistor to the circuit layer through the bonding pad. The light-emitting element is electrically connected between the first power line and the second power line, a first terminal of the first transistor is electrically connected to a data line of the plurality of data lines, a second terminal of the first transistor is electrically connected to a control terminal of the second transistor, a control terminal of the first transistor is electrically connected to a scan line of the plurality of scan lines, a first terminal of the second transistor is electrically connected to one of the first power line and the second power line, and a second terminal of the second transistor is electrically connected to the light-emitting element.

Another aspect of the present disclosure includes a fabricating method of a light-emitting panel. The fabricating method includes providing a substrate, a second transistor, and a light-emitting element, and forming at least one wire layer and a bonding layer on the substrate, thereby forming a circuit layer. The bonding layer includes a bonding pad electrically connected to the at least one wire layer, and forming the circuit layer includes forming a plurality of data lines, a plurality of scan lines, a first power line, and a second power line. The fabricating method also includes forming a first transistor on the substrate. At least a portion of a structure of the first transistor is arranged in a same layer as the at least one wire layer, a first terminal of the first transistor is electrically connected to a data line of the plurality of data lines, and a control terminal of the first transistor is electrically connected to a scan line of the plurality of scan lines. The fabricating method also includes electrically connecting the light-emitting element and the second transistor to the circuit layer through the bonding pad. The light-emitting element is electrically connected between the first power line and the second power line, a second terminal of the first transistor is electrically connected to a control terminal of the second transistor, a first terminal of the second transistor is electrically connected to one of the first power line and the second power line, and a second terminal of the second transistor is electrically connected to the light-emitting element.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

To make the objectives, technical solutions and advantages of the present disclosure more clear and explicit, the present disclosure is described in further detail with accompanying drawings and embodiments. It should be understood that the specific exemplary embodiments described herein are only for explaining the present disclosure and are not intended to limit the present disclosure.

Reference will now be made in detail to exemplary embodiments of the present disclosure, which are illustrated in the accompanying drawings. Wherever possible, the same reference numbers will be used throughout the drawings to refer to the same or like parts.

It should be noted that relative arrangements of components and steps, numerical expressions and numerical values set forth in exemplary embodiments are for illustration purpose only and are not intended to limit the present disclosure unless otherwise specified. Techniques, methods and apparatus known to the skilled in the relevant art may not be discussed in detail, but these techniques, methods and apparatus should be considered as a part of the specification, where appropriate.

It should be noted that in the present disclosure, relational terms such as "first" and "second" are used only to distinguish one entity or operation from another entity or operation, and do not necessarily require or imply any such actual relationship or order between these entities or operations.

It should be understood that, in describing a structure of a component, when a layer or an region is referred to as being "on" or "above" another layer or another region, the layer or the region may be directly on the other layer or the other region, or additional layers or additional regions may be included between the layer or the region and the other layer or the other region. Moreover, if the component is turned over, the layer or the region is "below" or "under" the other layer or the other region.

The present disclosure provides a light-emitting panel. The light-emitting panel may be used to generate backlight, for example, as a backlight source of a liquid crystal display (LCD), or may be directly used for displaying an image, that is, as a display panel.

Figure 1:
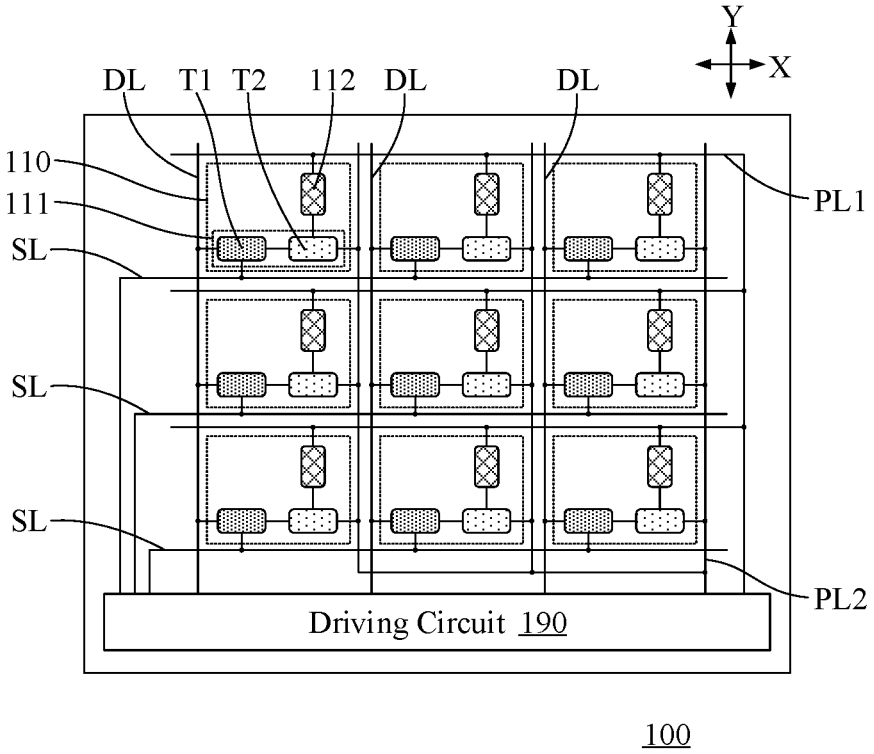
FIG. 1 illustrates a structural diagram of a light-emitting panel consistent with the disclosed embodiments of the present disclosure.

FIG. 1 illustrates a structural diagram of a light-emitting panel consistent with the disclosed embodiments of the present disclosure. The light-emitting panel 100 includes a plurality of light-emitting units 110 arranged in an array. Each light-emitting unit 110 of the plurality of light-emitting units includes a light-emission control module 111 and at least one light-emitting element 112. The at least one light-emitting element 112 is electrically connected to the light-emission control module 111.

The light-emitting panel 100 also includes a plurality of data lines DL, a plurality of scan lines SL, first power lines PL1, and second power lines PL2. The plurality of data lines DL is arranged in a first direction X. Each data line DL of the plurality of data lines is electrically connected to the light-emission control modules 111 of the light-emitting units 110 arranged in a second direction Y. The second direction Y and the first direction X intersect with each other. In one embodiment, the first direction X is substantially perpendicular to the second direction Y. The plurality of scan lines SL is arranged along the second direction Y. Each scan line SL of the plurality of scan lines is electrically connected to the light-emission control modules 111 of the light-emitting units 110 arranged in the first direction X.

Figure 2:
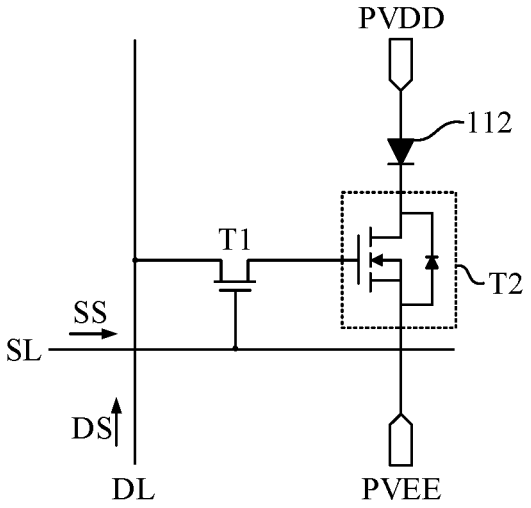
FIG. 2 illustrates a structural diagram of a light-emitting unit in a light-emitting panel consistent with the disclosed embodiments of the present disclosure.
Figure 3:
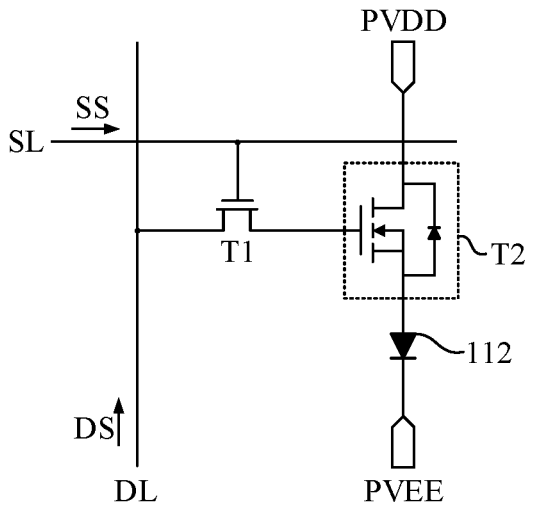
FIG. 3 illustrates a structural diagram of a light-emitting unit in another light-emitting panel consistent with the disclosed embodiments of the present disclosure.

FIG. 2 illustrates a structural diagram of a light-emitting unit in a light-emitting panel consistent with the disclosed embodiments of the present disclosure. FIG. 3 illustrates a structural diagram of a light-emitting unit in another light-emitting panel consistent with the disclosed embodiments of the present disclosure. As shown in FIGS. 2 and 3, in each light-emitting unit 110, the at least one light-emitting element 112 is electrically connected between the first power line PL1 and the second power line PL2. The light-emission control module 111 includes a first transistor T1 and a second transistor T2. A first terminal of the first transistor T1 is electrically connected to the data line DL, a second terminal of the first transistor T1 is electrically connected to a control terminal of the second transistor T2, and a control terminal of the first transistor T1 is electrically connected to the scan line SL. A first terminal of the second transistor T2 is electrically connected to one of the first power line PL1 and the second power line PL2, a second terminal of the second transistor T2 is electrically connected to the light-emitting element 112.

The light-emission control module 111 receives a scan signal SS through the scan line SL. The light-emission control module 111 receives a data signal DS through the data line DL. The data signal DS is a pulse width modulation (PWM) signal. The at least one light-emitting element 112 receives a first power supply signal PVDD through the first power line PL1, and the at least one light-emitting element 112 receives a second power supply signal PVEE through the second power line PL2.

In one embodiment, as shown in FIG. 2, the second transistor T2 is connected between the second power line PL2 and the light-emitting element 112. In another embodiment, as shown in FIG. 3, the second transistor T2 is connected between the first power line PL1 and the light-emitting element 112. In the present disclosure, positional relationships of the light-emitting element 112 and the second transistor T2 between the first power line PL1 and the second power line PL2 may be adjusted according to actual needs of a light-emitting panel 100.

In the present disclosure, the light-emitting panel 100 includes the light-emitting units 110 arranged in an array. For example, when the light-emitting units 110 are arranged in M rows and N columns (M and N are integers greater than or equal to 2), the number of the light-emitting units 110 is M×N. In a conventional solution, each light-emitting unit 110 receives a data signal DS through a signal line to achieve independent brightness control of each light-emitting unit 110, and thus a total of M×N signal lines for brightness control are required. In the present disclosure, the light-emitting panel 100 includes data lines DL arranged in the first direction X and scan lines SL arranged in the second direction Y. Each data line DL is electrically connected to the light-emission control modules 111 of the light-emitting units 110 arranged in the second direction Y. Each scan line SL is electrically connected to the light-emission control modules 111 of the light-emitting units 110 arranged in the first direction X. A total number of the scan lines SL and the data lines DL is M+N. Accordingly, in the present disclosure, the light-emitting panel 100 may use a smaller number of signal lines (M+N) to realize a regional brightness control of the light-emitting units 110 (each light-emitting unit 110 is a region). In a same wiring space, with a same number of signal lines, brightness control of a larger number of light-emitting units 110 may be achieved, and the number of regions may thus be increased.

In a light-emitting panel 100 provided by the present disclosure, the at least one light-emitting element 112 of each light-emitting unit 110 is electrically connected between the first power line PL1 and the second power line PL2, such that brightness of the LED may be adjusted by controlling a pulse width of the PWM signal. Accordingly, current-driven light emission with different gray scales may be realized. The light-emission control module 111 is electrically connected to the light-emitting element 112 for controlling the brightness of the light-emitting element 112. The light-emission control module 111 includes a first transistor T1 and a second transistor T2. When receiving the scan signal SS of the scan line SL and gated on, the first transistor T1 may transmit a data signal DS of the data line DL to the control terminal of the second transistor T2. The data signal DS is a pulse width modulation (PWM) signal. The second transistor T2 may control a pulse width of the PWM signal according to the data signal DS to realize brightness control of the light-emitting element 112 in the light-emitting unit 110, that is, realize the regional brightness control of the light-emitting panel 100. As such, contrast of the light-emitting panel 100 when used for displaying an image may be increased, and image-display quality of the display device including the light-emitting panel 100 may be improved.

In one embodiment, each light-emitting unit 110 includes one light-emitting element 112. In some other embodiments, each light-emitting unit 110 may include two, three, or more light-emitting elements 112. The light-emitting elements 112 in each light-emitting unit 110 may be connected in series or in parallel. The present disclosure does not limit the number of the light-emitting elements 112 in each light-emitting unit 110, and connection methods of the light-emitting elements 112 in each light-emitting unit 110.

The light-emitting element 112 may be a self-luminous element driven by electric current, for example, a light-emitting diode (LED). In one embodiment, the light-emitting element 112 may be a sub-millimeter LED (mini-LED) or a micro-LED to have a smaller size, such that the light-emitting panel 100 may have a higher pixel density. One of the first terminal and the second terminal of the light-emitting element 112 is an anode, and the other is a cathode.

In one embodiment, as shown in FIG. 1, the light-emitting panel 100 also includes a driving circuit 190. The plurality of data lines DL, the plurality of scan lines SL, the first power lines PL1, and the second power lines PL2 are electrically connected to the driving circuit 190. The driving circuit 190 may provide data signals DS to the data lines DL, scan signals SS to the scan lines SL, first power signals PVDD to the first power lines PL1, and second power signals PVEE to the second power lines PL2. In one embodiment, when the driving circuit 190 provides the data signals DS, the driving circuit 190 may convert a traditional analog voltage modulation signal into a PWM signal. Moreover, the driving circuit 190 may adjust a duty ratio of the data signals DS, such that the light-emitting brightness of the light-emitting elements 112 may be controlled.

In one embodiment, the at least one light-emitting element 112 may receive the first power supply signal PVDD through the first power line PL1. The at least one light-emitting element 112 may receive the second power supply signal PVEE through the second power line PL2. Both the first power supply signal PVDD and the second power supply signal PVEE are DC signals. The second transistor T2 and the light-emitting element 112 are connected between the first power line PL1 and the second power line PL2. In the light-emitting unit 110, the second transistor T2 may control the direct current flowing through the light-emitting element 112, such that the brightness control of the light-emitting element 112 may be realized.

In one embodiment, the second transistor T2 is a field-effect transistor (FET). Specifically, the FET may be a junction field-effect transistor (JFET), and it may also be a metal-oxide-semiconductor field-effect transistor (MOSFET). The second transistor T2 and the light-emitting element 112 are connected between the first power line PL1 and the second power line PL2. That is, the second transistor T2 and the light-emitting element 112 are arranged between current sources. Accordingly, the second transistor T2 may generate power consumption, and the power consumption may be useless for a light-emitting function of the light-emitting panel 100. On-resistance of the second transistor T2 may have an influence on the power consumption. In one embodiment, the second transistor T2 is an FET, and the channel material of the second transistor T2 is usually polysilicon, and thus the on-resistance may be small (the on-resistance is usually in an order of several ohms). Accordingly, the power consumption of the second transistor T2 may be kept small, and thus the useless power consumption and overall power consumption of the light-emitting panel may be reduced.

When the second transistor T2 is an FET, one terminal of the first terminal and the second terminal of the second transistor T2 may be a source, and the other terminal may be a drain. The control terminal of the second transistor T2 may be a gate.

In some embodiments, the first transistor T1 may also be an FET. When the first transistor T1 is an FET, one terminal of the first terminal and the second terminal of the first transistor T1 may be a source, and the other terminal may be a drain. The control terminal of the first transistor T1 may be a gate.

In one embodiment, the plurality of data lines DL, the plurality of scan lines SL, the first power lines PL1, and the second power lines PL2 are electrically connected to the driving circuit 190. In some other embodiments, signals for the data lines DL and the scan lines SL may be respectively provided by their corresponding driving modules.

Figure 4:
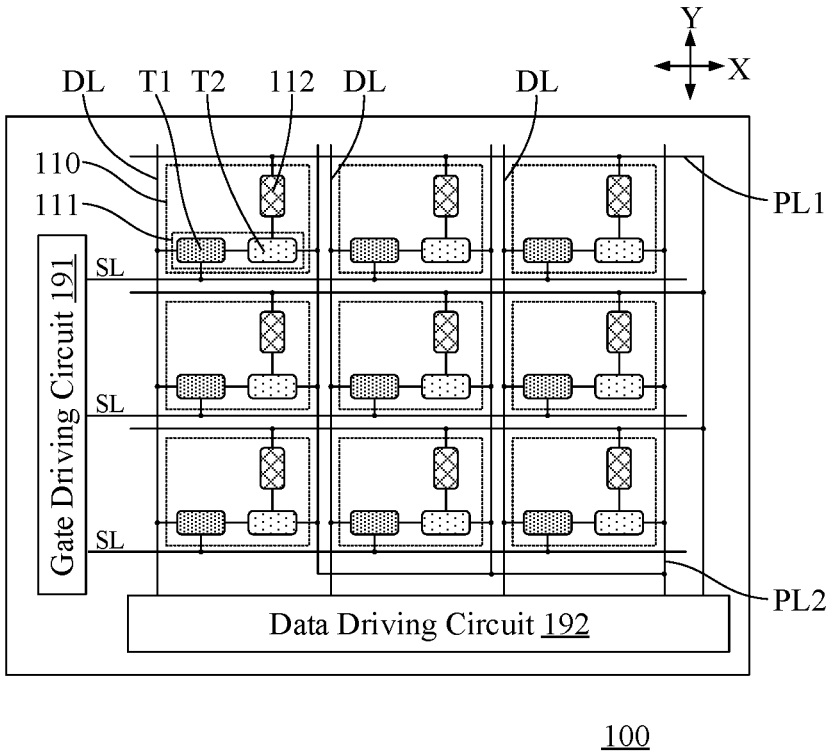
FIG. 4 illustrates a structural diagram of another light-emitting panel consistent with the disclosed embodiments of the present disclosure.

FIG. 4 illustrates a structural diagram of another light-emitting panel consistent with the disclosed embodiments of the present disclosure. In one embodiment, as shown in FIG. 4, the light-emitting panel 100 also includes a gate driving circuit 191 and a data driving circuit 192. The gate driving circuit 191 is located on at least one side of the plurality of light-emitting units 110 in the first direction X, and the scan lines SL are electrically connected to the gate driving circuit 191. The data driving circuit 192 is located on at least one side of the plurality of light-emitting units 110 in the second direction Y. The data lines DL, the first power lines PL1 and the second power lines PL2 are electrically connected to the data driving circuit 192. In some embodiments, the light-emitting panel may also include a timing controller. The timing controller may provide timing signals to the gate driving circuit 191 and the data driving circuit 192. In one embodiment, the gate driving circuit may be a shifting register including a plurality of cascaded shifting register units, or a gate driving IC. The present disclosure does not limit a configuration of the gate driving circuit.

Figure 5:
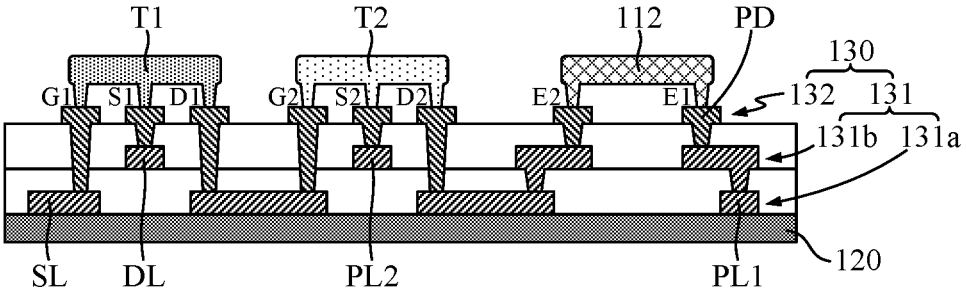
FIG. 5 illustrates a cross-sectional view of a light-emitting unit in another light-emitting panel consistent with the disclosed embodiments of the present disclosure.

FIG. 5 illustrates a cross-sectional view of a light-emitting unit in another light-emitting panel consistent with the disclosed embodiments of the present disclosure. In one embodiment, the light-emitting panel 100 also includes a substrate 120 and a circuit layer 130 on the substrate 120. The circuit layer 130 includes at least one wire layer 131 and a bonding layer 132 on a side of the at least one wire layer 131 away from the substrate 120. The bonding layer 132 includes bonding pads PD electrically connected to the at least one wire layer 131. At least one of the data line DL, the scan line SL, the first power line PL1, and the second power line PL2 is arranged on the at least one wire layer 131. The light-emitting element 112 and the second transistor T2 are electrically connected to the at least one wire layer 131 through the bonding pads PD, respectively. The light-emitting element 112 and the second transistor T2 may be prefabricated respectively, thus a process of forming the light-emitting element 112 and the second transistor T2 may not be included in a process of forming the circuit layer 130. After the circuit layer 130 is formed, the light-emitting element 112 and the second transistor T2 that are prefabricated may be electrically connected to the bonding pads PD by bond binding. Accordingly, the production time of the light-emitting panel 100 may be saved, and the production efficiency may be improved.

As shown in FIG. 5, in one embodiment, the first transistor T1 is also electrically connected to the at least one wire layer 131 through the bonding pads PD. That is, the first transistor T1, the second transistor T2, and the light-emitting element 112 are all prefabricated elements. In one embodiment, the first transistor T1 and the second transistor T2 are both prefabricated MOS tubes. In a fabricating process of the light-emitting panel 100, the process of forming the circuit layer 130 on the substrate may not include a process of forming the first transistor T1, the second transistor T2 and the light-emitting element 112. After the process of forming the circuit layer 130 is completed, the first transistor T1, the second transistor T2, and the light-emitting element 112 that are prefabricated may be connected to the bonding pads PD by bond binding. A process of prefabricating the first transistor T1, the second transistor T2, and the light-emitting element 112 may be performed separately from the process of forming the circuit layer 130 on the substrate 120. The process of prefabricating the first transistor T1, the second transistor T2, and the light-emitting element 112 and the process of forming the circuit layer 130 on the substrate 120 may be performed at a same time. Alternatively, the first transistor T1, the second transistor T2, and the light-emitting element 112 may be provided directly from incoming supplies, and thus the fabricating efficiency of the light-emitting panel 100 may be further improved.

In a process of electrically connecting the light-emitting element 112, the first transistor T1 and the second transistor T2 to the wiring layer 130 through the bonding pads PD, the light-emitting element 112 is electrically connected between the first power line PL1 and the second power line PL2. The first terminal S1 of the first transistor T1 is electrically connected to the data line DL, the second terminal D1 of the first transistor T1 is electrically connected to the control terminal G2 of the second transistor T2. The control terminal G1 of the first transistor T1 is electrically connected to the scan line SL. The first terminal S2 of the second transistor T2 is electrically connected to one of the first power line PL1 and the second power line PL2. The second terminal D2 of the second transistor T2 is electrically connected to the light-emitting element 112. In one embodiment, the first terminal S2 of the second transistor T2 is electrically connected to the second power line PL2, the first terminal E1 of the light-emitting element 112 is electrically connected to the first power line PL1, and the second terminal E2 of the light-emitting element 112 is electrically connected to the second terminal D2 of the second transistor T2.

In one embodiment, as shown in FIG. 5, the first power line PL1 and the scan lines SL are arranged on the at least one wire layer 131. The first power line PL1 and the scan lines SL are arranged on a same layer. In some embodiments, as shown in FIG. 1 or FIG. 4, each first power line PL1 extends substantially in the first direction X, and the plurality of first power lines PL1 are arranged in the second direction Y. Meanwhile, each scan line SL extends substantially in the first direction X, and the plurality of scan lines SL are arranged in the second direction Y. That is, the first power line PL1 and the scan line SL are arranged substantially in parallel. Accordingly, by arranging at least part of the first power lines PL1 and at least part of the scan lines SL on a same layer, the at least part of the first power lines PL1 and the at least part of the scan lines SL may be formed in a same patterning process. Thus, fabricating process may be simplified, and the at least part of the first power lines PL1 and the at least part of the scan lines SL may not interfere with each other.

In one embodiment, as shown in FIG. 5, the at least one wire layer 131 includes a first wire layer 131*a* and a second wire layer 131*b*. The second wire layer 131*b* is located on a side of the first wire layer 131*a* away from the substrate 120. The first power line PL1 and the scan line SL are arranged on a same layer on the first wire layer 131*a*, and the data lines DL and the second power lines PL2 are arranged on a same layer on the second conductive layer 131*b*. As shown in FIG. 1 or FIG. 4, in some embodiments, each data line DL extends substantially in the second direction Y, and the plurality of data lines DL are arranged in the first direction X. Meanwhile, each second power line PL2 extends substantially in the second direction Y, and the plurality of second power supply lines PL2 are arranged in the first direction X. That is, the data lines DL and the second power lines PL2 are substantially parallel to each other. By arranging at least part of the data lines DL and at least part of the second power lines PL2 on a same layer, the interference possibility between the at least part of the data lines DL and the at least part of the second power lines PL2 may be small.

In one embodiment, at least part of the first power lines PL1 and at least part of the scan lines SL are arranged on a same layer. Accordingly, the at least part of the first power lines PL1 and the at least part of the scan lines SL may be formed in a same patterning process. At least part of the data lines DL and at least part of the second power lines PL2 are arranged on a same layer. Accordingly, the at least part of the data lines DL and the at least part of the second power lines PL2 may be formed in a same patterning process. Thus, the fabricating process may be simplified, and the fabricating efficiency of the light-emitting panel 100 may be improved. In addition, the first power lines PL1 and the scan lines SL that are extending substantially in the first direction X, and the data lines DL and the second power lines PL2 that are extending substantially in the second direction Y may be separately arranged at different wire layers. Accordingly, interference between the signal lines extending in two different directions may be avoided, and circuit stability of the light-emitting panel 100 may thus be ensured.

Figure 6:
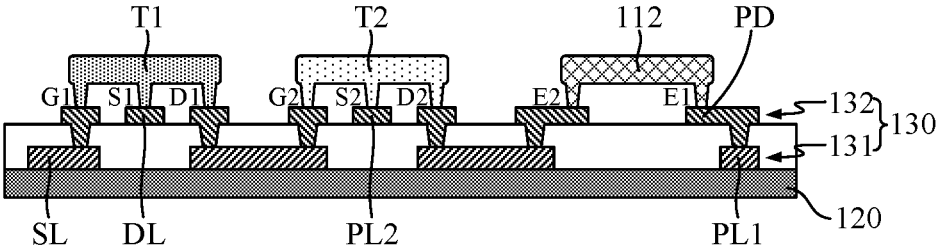
FIG. 6 illustrates a cross-sectional view of a light-emitting unit in another light-emitting panel consistent with the disclosed embodiments of the present disclosure.

FIG. 6 illustrates a cross-sectional view of a light-emitting unit in another light-emitting panel consistent with the disclosed embodiments of the present disclosure. In one embodiment, the light-emitting panel 100 includes a substrate 120 and a circuit layer 130 on the substrate 120. The circuit layer 130 includes at least one wire layer 131 and a bonding layer 132 on a side of the at least one wire layer 131 away from the substrate 120. The bonding layer 132 includes bonding pads PD electrically connected to the at least one wire layer 131. In one embodiment, a first transistor T1, a second transistor T2, and a light-emitting element 112 are all prefabricated elements. The first transistor T1, the second transistor T2, and the light-emitting element 112 are respectively electrically connected to the at least one wire layer 131 through the bonding pads PD, and the fabricating efficiency of the light-emitting panel 100 may thus be improved. In one embodiment, the bonding layer 132 is made of a metal material. Accordingly, resistance of the bonding layer may be reduced, and bonding of the first transistor T1, the second transistor T2, and the light-emitting element 112 may be improved.

In one embodiment, at least one of the data lines DL, the scan lines SL, the first power lines PL1, and the second power lines PL2 is arranged on the bonding layer 132. Accordingly, the signal lines in the wire layer 131 may be reduced, and the number of layers required for the wire layer 131 may be reduced. The bonding pads PD of the bonding layer 132 and at least one of the data lines DL, the scan lines SL, the first power lines PL1, and the second power lines PL2 may be formed at a same time. Accordingly, the fabricating process may be simplified, and the fabricating efficiency of the light-emitting panel 100 may be improved.

In one embodiment, as shown in FIG. 6, the data lines DL, the second power lines PL2, and the bonding pads PD of the bonding layer 132 are arranged on a same layer. Accordingly, the data lines DL, the second power lines PL2 and the bonding pads PD of the bonding layers 132 may be formed simultaneously in a same patterning process. In one embodiment, the wire layer 131 includes one layer, and the first power lines PL1 and the scan lines SL are arranged on the wire layer 131. That is, the first power lines PL1 and the scan lines SL are arranged on a same layer.

In the light-emitting panel 100 disclosed above, only one layer of wire layer 131 needs to be formed, and the circuit layer 130 may still accommodate the data lines DL, the scan lines SL, the first power lines PL1 and the second power lines PL2. Accordingly, the fabricating efficiency of the light-emitting panel 100 may be improved, and a thickness of the light-emitting panel 100 may be reduced.

Figure 7:
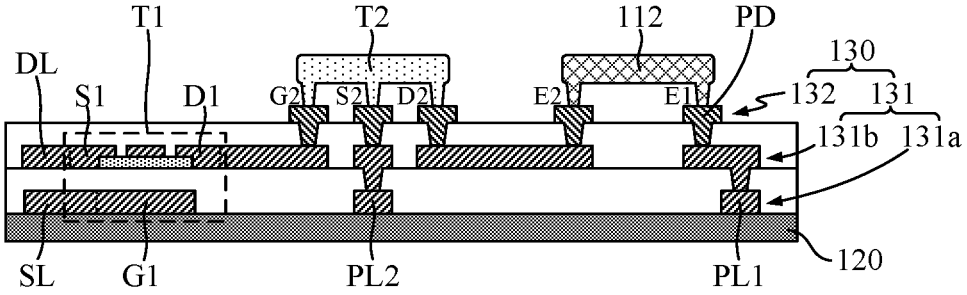
FIG. 7 illustrates a cross-sectional view of a light-emitting unit in another light-emitting panel consistent with the disclosed embodiments of the present disclosure.

FIG. 7 illustrates a cross-sectional view of a light-emitting unit in another light-emitting panel consistent with the disclosed embodiments of the present disclosure. In one embodiment, as shown in FIG. 7, the light-emitting panel 100 includes a substrate 120 and a circuit layer 130 on the substrate 120. The circuit layer 130 includes at least one wire layer 131 and a bonding layer 132 on a side of the at least one wire layer 131 away from the substrate 120. The bonding layer 132 includes bonding pads PD electrically connected to the at least one wire layer 131. In one embodiment, the second transistor T2 and the light-emitting element 112 are prefabricated elements. The second transistor T2 and the light-emitting element 112 are respectively electrically connected to the at least one wire layer 131 through the bonding pads PD. Accordingly, the fabricating efficiency of the light-emitting panel 100 may be improved.

In one embodiment, as shown in FIG. 7, the first transistor T1 is a thin film transistor (TFT). At least a portion of a structure of the first transistor T1 and the at least one wire layer 131 are arranged on a same layer. Specifically, the control terminal G1 of the first transistor T1 and the scan line SL are arranged on a same layer, and the first terminal S1 and the second terminal D1 of the first transistor T1 and the data lines DL are arranged in a same layer. For example, in one embodiment, the at least one wire layer 131 includes a first wire layer 131*a* and a second wire layer 131*b*. The second wire layer 131*b* is located on a side of the first wire layer 131*a* away from the substrate 120. At least part of the scan lines SL, at least part of the first power lines PL1, and at least part of the second power lines PL2 and the control terminal G1 of the first transistor T1 are arranged on a same layer on the first wire layer 131*a*. At least part of the data lines DL and the first terminal S1 and the second terminal D1 of the first transistor T1 are arranged on a same layer on the second conductive line layer 131*b*.

In one embodiment, the first transistor T1 is a TFT, and at least a portion of a structure of the first transistor T1 and the at least one wire layer 131 are arranged on a same layer. Accordingly, the at least the portion of the structure of the first transistor T1 may be fabricated while the wire layer 131 is formed. Thus, use of prefabricated first transistor T1 may be saved, and the production cost of the light-emitting panel 100 may be reduced. Though a mobility of the first transistor T1 in a TFT form may be lower than a mobility of the first transistor T1 in a prefabricated form, and on-resistance of the first transistor T1 in a TFT may be larger (the on-resistance is usually on an order of several kiloohms), the first transistor T1 may not be arranged between current sources. Accordingly, the first transistor T1 may have almost no useless power consumption in the light-emitting panel 100, and thus the luminous efficiency of the light-emitting panel 100 may not be adversely affected. It should be noted that in FIG. 7, only a bottom gate structure is used for illustration. The first transistor T1 may also have a top gate structure. The present disclosure does not limit a configuration of the first transistor T1. In addition, a film layer of the first transistor T1 may be designed according to actual requirements.

Figure 8:
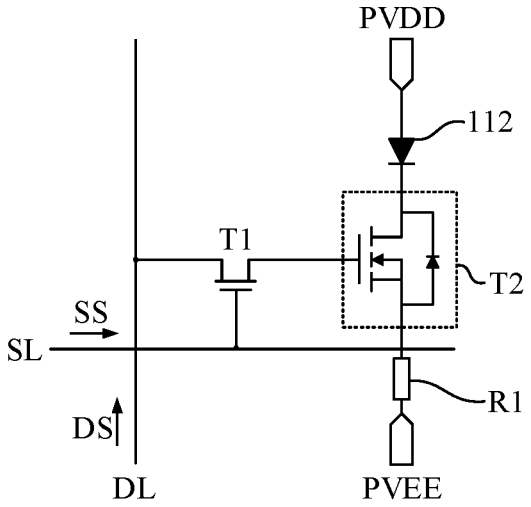
FIG. 8 illustrates an equivalent circuit of a light-emitting unit in another light-emitting panel consistent with the disclosed embodiments of the present disclosure.
Figure 9:
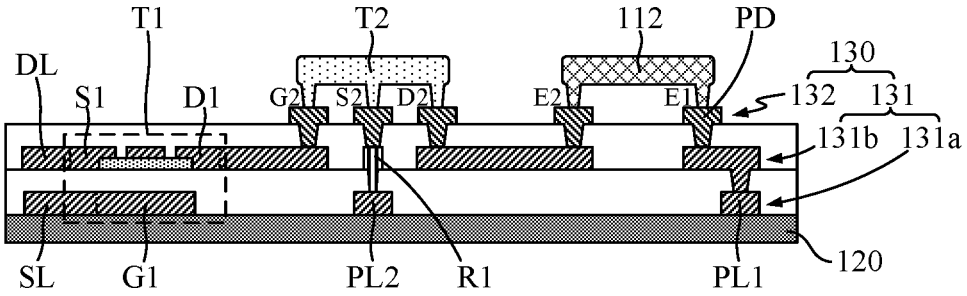
FIG. 9 illustrates a cross-sectional view of a light-emitting unit in another light-emitting panel consistent with the disclosed embodiments of the present disclosure.

FIG. 8 and FIG. 9 respectively illustrate an equivalent circuit and a cross-sectional view of a light-emitting unit in another light-emitting panel consistent with the disclosed embodiments of the present disclosure. In some embodiments, as shown in FIGS. 8 and 9, each light-emitting unit 110 also includes a first resistor R1. The first resistor R1 is electrically connected between the first power line PL1 and the second power line PL2. In one embodiment, the first resistor R1 is electrically connected between the second power line PL2 and the first terminal S2 of the second transistor T2. The light-emitting element 112 is electrically connected between the first power line PL1 and the second terminal D2 of the second transistor T2. In some other embodiments, the first resistor R1 may be electrically connected between the second transistor T2 and the first power line PL1.

In the above configuration, the light-emitting element 112, the second transistor T2, and the first resistor R1 are electrically connected between the first power line PL1 and the second power line PL2. The first power signal PVDD transmitted by the first power line PL1 is at, for example, a high electric level, and the second power signal PVEE transmitted by the second power line PL2 is at, for example, a zero electric level (zero volt). A voltage of the PVDD depends on a threshold voltage of the light-emitting element 112, and the voltage of the PVDD may be greater than or equal to the threshold voltage of the light-emitting element 112. Voltages of the control terminal (gate) G2, the first terminal (source) S2, and the second terminal (drain) D2 of the second transistor T2 are Vg, Vs, and Vd respectively. Correspondingly, the gate-source voltage is Vgs, and the threshold voltage of the second transistor T2 is Vth. The resistance of the first resistor R1 is denoted as Rp. A sum of the wiring resistance between the first power supply line PL1 and the second power supply line PL2, the resistance of the light-emitting element 112, and the on-resistance of the second transistor T2 is denoted as Rc.

When Vgs>Vth, the current I flowing through the second transistor T2 may be given by I=(PVDD−VLED)/(Rp+Rc), where VLED is a voltage on the light-emitting element 112. When Vgs=Vth, the current I flowing through the second transistor T2 may be given by I=(Vg−Vth)/Rp. When Vgs<Vth, the current I through the second transistor T2 may be given by I=0. In a simulation example, a standard setting of the first power signal PVDD is 5 volts (V), and the second power signal PVEE is zero volt. By precisely adjusting the PVDD voltage, the current flowing through the LED may be stabilized at around 5 milliamperes (mA) when the first power signal PVDD is a pulse signal of 0 to 10V.

In the above configuration, the first resistor R1 is a current limiting resistor. By setting the first resistor R1, the current flowing through the light-emitting element 112 may be limited within a set current range. Accordingly, the current flowing through the light-emitting element 112 may not change significantly with fluctuation of the first power signal PVDD, and thus a service life of the light-emitting element 112 may be increased.

In one embodiment, with continuous reference to FIG. 8 and FIG. 9, the first resistor R1 and the at least one wire layer 131 are arranged on a same layer. Accordingly, fabricating of the first resistor R1 may be integrated in a fabricating process of the at least one wire layer 131, and a fabricating cost of the light-emitting panel 100 may thus be reduced. In some other embodiments, the first resistor R1 may be an external prefabricated element, and the first resistor R1 may be electrically connected to the at least one wire layer 131 through the bonding pads PD. Accordingly, production efficiency of the light-emitting panel 100 may be improved. Moreover, the first resistor R1 may be replaced and adjusted, and thus maintainability and customizability of the light-emitting panel 100 may be improved.

In one embodiment, resistance of the first resistor R1 may be less than or equal to approximately 100 ohms. A specific resistance value of the first resistor R1 may be related to a circuit voltage drop between the first power line PL1 and the second power line PL2. The first resistor R1 may compensate for the circuit voltage drop between the first power line PL1 and the second power line PL2.

Figure 10:
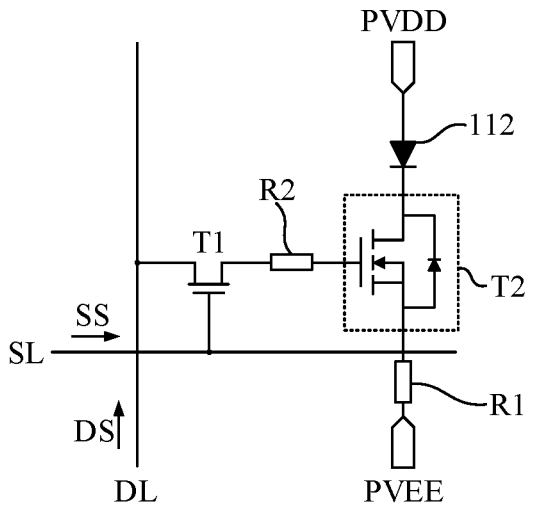
FIG. 10 illustrates an equivalent circuit of a light-emitting unit in another light-emitting panel consistent with the disclosed embodiments of the present disclosure.
Figure 11:
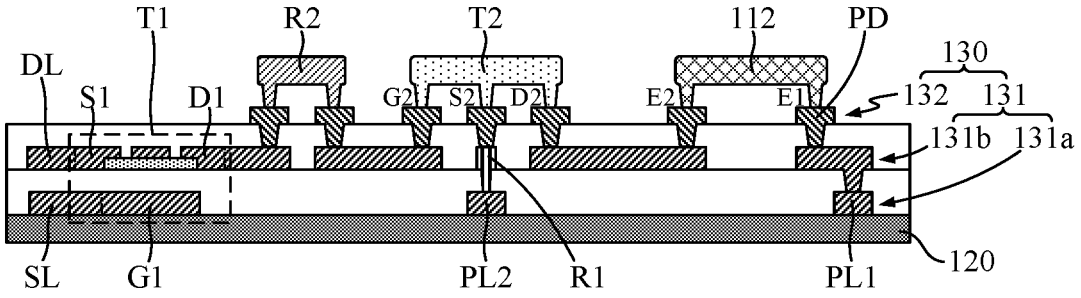
FIG. 11 illustrates a cross-sectional view of a light-emitting unit in another light-emitting panel consistent with the disclosed embodiments of the present disclosure.

FIG. 10 and FIG. 11 respectively illustrate an equivalent circuit and a cross-sectional view of a light-emitting unit in another light-emitting panel consistent with the disclosed embodiments of the present disclosure. In some embodiments, as shown in FIG. 10 and FIG. 11, the light-emission control module 111 also includes a second resistor R2. The second resistor R2 may be electrically connected between the second terminal D1 of the first transistor T1 and the control terminal G2 of the second transistor T2. The second resistor R2 is a damping resistor. By setting the second resistor R2, influence of a parasitic capacitance of the gate (control terminal G2) of the second transistor T2 on the data signal DS may be eliminated, and stability of signal transmission may thus be improved.

In one embodiment, the second resistor R2 is an external prefabricated component. The second resistor R2 is electrically connected to the at least one wire layer 131 through the bonding pads PD. By providing the external second resistor R2, the production efficiency of the light-emitting panel 100 may be improved. Moreover, replacement and adjustment of the second resistor R2 may be convenient, and thus maintainability and customizability of the light-emitting panel 100 may be improved. In some other embodiments, the second resistor R2 and the at least one wire layer 131 may be arranged on a same layer, and thus the fabricating cost of the light-emitting panel 100 may be reduced.

Figure 12:
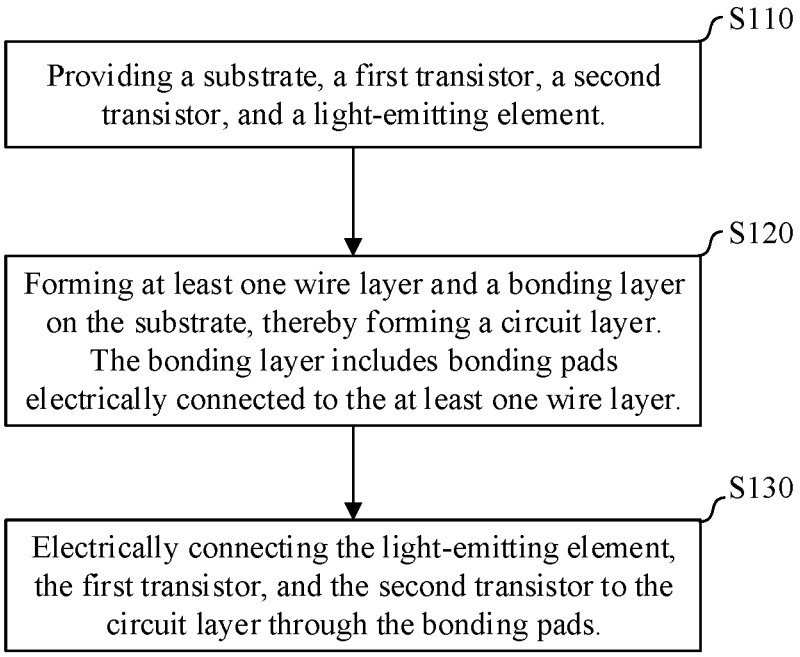
FIG. 12 illustrates a flowchart of a fabricating method of a light-emitting panel consistent with the disclosed embodiments of the present disclosure.
Figure 13:
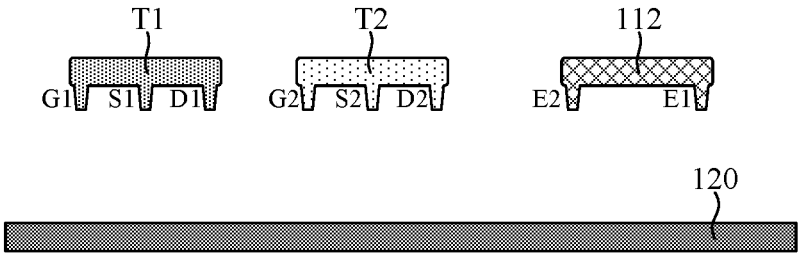
FIGS. 13 to 15 illustrate schematics of structures corresponding to certain stages of a fabricating method of a light-emitting panel consistent with the disclosed embodiments of the present disclosure.
Figure 14:
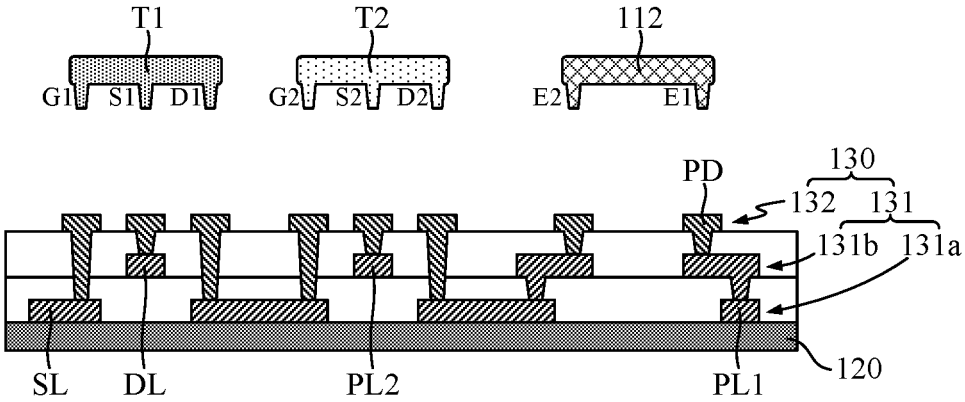
Figure 15:
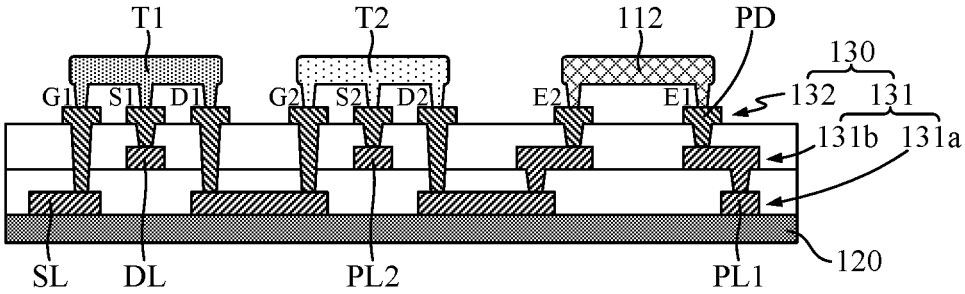

The present disclosure also provides a fabricating method of a light-emitting panel. FIG. 12 illustrates a flowchart of a fabricating method of a light-emitting panel consistent with the disclosed embodiments of the present disclosure. FIGS. 13 to 15 illustrate schematics of structures corresponding to certain stages of a fabricating method of a light-emitting panel consistent with the disclosed embodiments of the present disclosure. In one embodiment, the fabricating method of the light-emitting panel includes steps S110 to S130.

In step S110, as shown in FIG. 13, a substrate 120, a first transistor T1, a second transistor T2, and a light-emitting element 112 are provided. The first transistor T1, the second transistor T2, and the light-emitting element 112 are all prefabricated elements. The first transistor T1 and the second transistor T2 are, for example, FETs, and the light-emitting element 112 is, for example, an LED. The substrate 120 may be a glass substrate, a printed circuit board substrate, or a flexible circuit board substrate, etc., and may also be another substrate known to those skilled in the art that may be used for wiring.

In step S120, as shown in FIG. 14, at least one wire layer 131 and a bonding layer 132 are formed on the substrate 120, and thus a circuit layer 130 is formed. The bonding layer 132 includes bonding pads PD electrically connected to the at least one wire layer 131. A process of forming the circuit layer 130 includes forming a plurality of data lines DL, a plurality of scan lines SL, first power lines PL1, and second power lines PL2. In one embodiment, the at least one wire layer 131 includes a first wire layer 131*a* and a second wire layer 131*b*. The second wire layer 131*b* is located on a side of the first wire layer 131*a* away from the substrate 120. The first power lines PL1 and the scan lines SL are arranged on a same layer on the first conductive line layer 131*a*, and the data lines DL and the second power lines PL2 are arranged on a same layer on the second conductive layer 131*b*.

In step S130, as shown in FIG. 15, the light-emitting element 112, the first transistor T1, and the second transistor T2 are electrically connected to the circuit layer 130 through the bonding pads PD. The light-emitting element 112 is electrically connected between the first power line PL1 and the second power line PL2. A first terminal S1 of the first transistor T1 is electrically connected to the data line DL. A second terminal D1 of the first transistor T1 is electrically connected to a control terminal G2 of the second transistor T2. A control terminal G1 of the first transistor T1 is electrically connected to the scan line SL. The first terminal S2 of the second transistor T2 is electrically connected to one of the first power line PL1 and the second power line PL2. The second terminal D2 of the second transistor T2 is electrically connected to the light-emitting element 112. So far, the light-emitting panel 100 is obtained.

In an exemplary light-emitting panel 100 provided by the present disclosure, at least one light-emitting element 112 of each light-emitting unit 110 is electrically connected between the first power line PL1 and the second power line PL2. As such, the light-emitting element may be driven to light by electric current. A light-emission control module 111 is electrically connected to the light-emitting element 112 for controlling brightness of the light-emitting element 112. The light-emission control module 111 includes a first transistor T1 and a second transistor T2. When receiving the scan signal SS of the scan line SL and gated on, the first transistor T1 may transmit the data signal DS of the data line DL to the control terminal G2 of the second transistor T2. The data signal DS is a pulse width modulation signal. According to the data signal DS, the second transistor T2 may control the electric current flowing through the light-emitting element 112. In this way, brightness control of the light-emitting elements 112 in the light-emitting unit 110 may be realized, that is, regional brightness control of the light-emitting panel 100 may be realized. Accordingly, contrast of the light-emitting panel 100 when used for displaying images may be increased, and image displaying quality of a display device including the light-emitting panel 100 may be improved.

During the fabricating process of the light-emitting panel 100, the process of forming the first transistor T1, the second transistor T2 and the light-emitting element 112 may not be included in the process of forming the circuit layer 130 on the substrate. After the process of forming the circuit layer 130 is completed, the prefabricated first transistor T1, second transistor T2, and light-emitting element 112 may be connected to the bonding pads PD by bond binding. Steps of prefabricating the first transistor T1, the second transistor T2, and the light-emitting element 112 may be performed separately from steps of forming the circuit layer 130 on the substrate 120, or even at a same time. Alternatively, the first transistor T1, the second transistor T2, and the light-emitting element 112 may be provided directly from incoming supplies, and thus the fabricating efficiency of the light-emitting panel 100 may be further improved.

In one embodiment, the fabricating method of the light-emitting panel also includes providing a first resistor R1 and/or a second resistor R2, and electrically connecting the first resistor R1 and/or the second resistor R2 to the circuit layer 130 through the bonding pads PD. The first resistor R1 is electrically connected between the first power line PL1 and the second power line PL2. The second resistor R2 is electrically connected between the second terminal D1 of the first transistor T1 and the control terminal G2 of the second transistor T2. In some embodiments, a step of electrically connecting the first resistor R1 and/or the second resistor R2 to the circuit layer 130 through the bonding pads PD may be performed at a same time as the step S130. Fabricating efficiency of the light-emitting panel may thus be improved.

In one embodiment, the fabricating method of the light-emitting panel also includes forming the first resistor R1 and/or the second resistor R2 at a same time as step S120. That is, the first resistor R1 and/or the second resistor R2 and the at least one wire layer 131 are arranged on a same layer. A fabricating cost of the light-emitting panel 100 may thus be reduced.

The first resistor R1 is a current limiting resistor. By setting the first resistor R1, the current flowing through the light-emitting element 112 may be limited within a set current range. Accordingly, the current flowing through the light-emitting element 112 may not change significantly with fluctuation of the first power signal PVDD, and thus a service life of the light-emitting element 112 may be increased. The second resistor R2 is a damping resistor. By setting the second resistor R2, influence of a parasitic capacitance of the gate (control terminal G2) of the second transistor T2 on the data signal DS may be eliminated, and stability of signal transmission may thus be improved.

Figure 16:
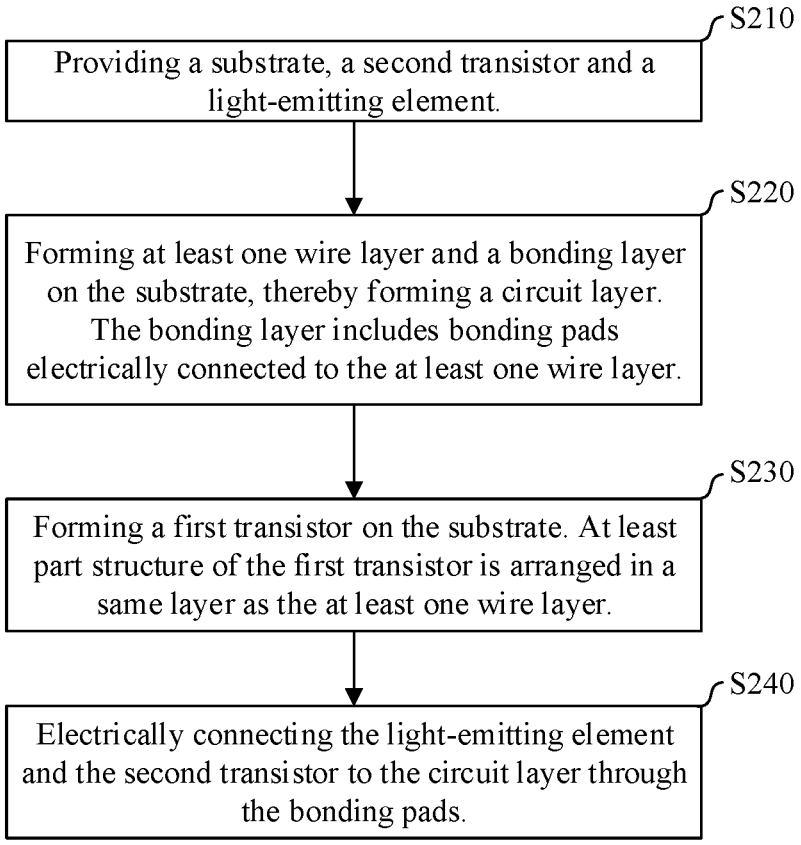
FIG. 16 illustrates a flowchart of another fabricating method of a light-emitting panel consistent with the disclosed embodiments of the present disclosure.
Figure 17:
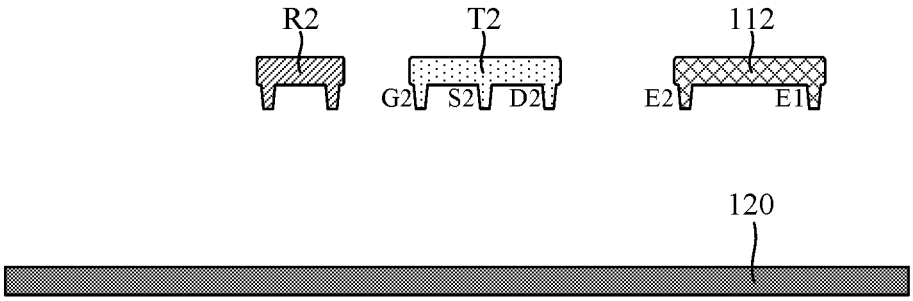
FIGS. 17 to 19 illustrate schematics of structures corresponding to certain stages of another fabricating method of a light-emitting panel consistent with the disclosed embodiments of the present disclosure.
Figure 18:
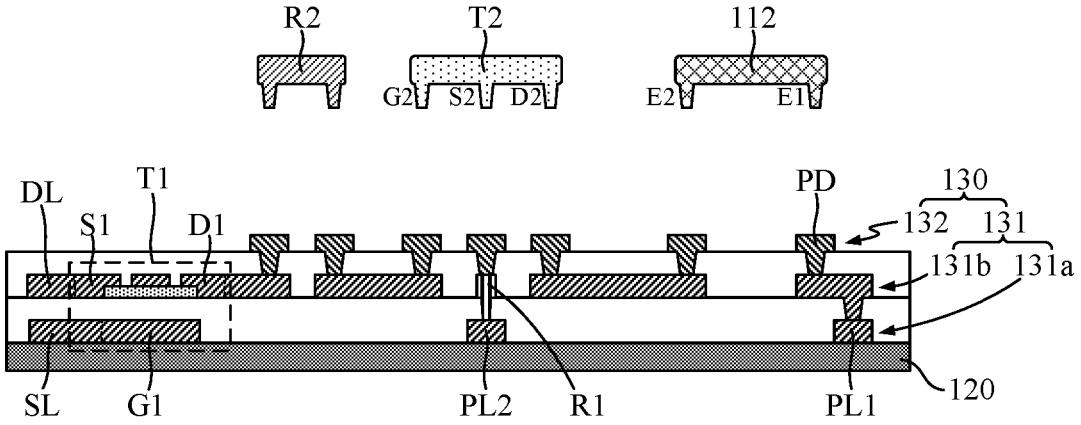
Figure 19:
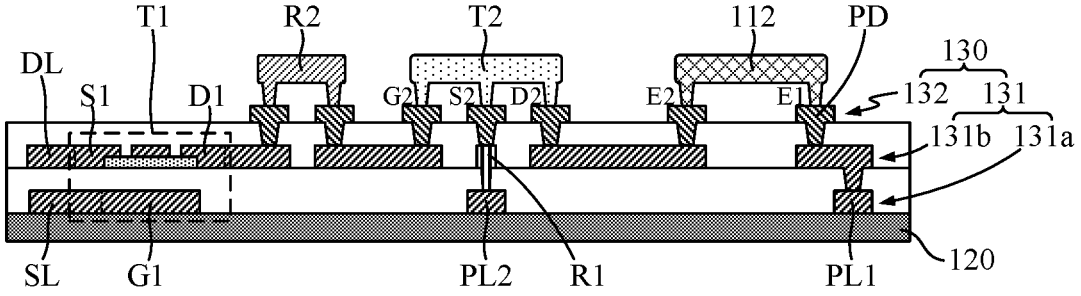

FIG. 16 illustrates a flowchart of another fabricating method of a light-emitting panel consistent with the disclosed embodiments of the present disclosure. FIGS. 17 to 19 illustrate schematics of structures corresponding to certain stages of another fabricating method of a light-emitting panel consistent with the disclosed embodiments of the present disclosure. In one embodiment, the fabricating method of the light-emitting panel includes steps S210 to S240.

In step S210, as shown in FIG. 17, a substrate 120, a second transistor T2, and a light-emitting element 112 are provided.

In step S220, as shown in FIG. 18, at least one wire layer 131 and a bonding layer 132 are formed on the substrate 120 to form a circuit layer 130. The bonding layer 132 includes bonding pads PD electrically connected to the at least one wire layer 131. In a process of forming the circuit layer 130, a plurality of data lines DL, a plurality of scan lines SL, first power lines PL1, and second power lines PL2 may be formed.

In step S230, with continuous reference to FIG. 18, a first transistor T1 is formed on the substrate 120. At least a portion of a structure of the first transistor T1 is arranged in a same layer as the at least one wire layer 131. A first terminal S1 of the first transistor T1 is electrically connected to the data line DL, and a control terminal G1 of the first transistor T1 is electrically connected to the scan line SL. In one embodiment, the first transistor T1 is a thin film transistor, and at least a portion of a structure of the first transistor T1 and the at least one wire layer 131 are arranged in a same layer. For example, in one embodiment, the at least one wire layer 131 includes a first wire layer 131*a* and a second wire layer 131*b*. The second wire layer 131*b* is located on a side of the first wire layer 131*a* away from the substrate 120. At least part of the scan lines SL, at least part of the first power lines PL1, and at least part of the second power lines PL2 and the control terminal G1 of the first transistor T1 are arranged on a same layer on the first wire layer 131*a*. At least part of the data lines DL and the first terminal S1 and the second terminal D1 of the first transistor T1 are arranged on a same layer on the second conductive line layer 131*b*.

In one embodiment, in step S230, a process of forming the at least the portion of the structure of the first transistor T1 and a process of forming the at least one wire layer 131 in step S220 may be performed simultaneously. As such, the fabricating efficiency of the light-emitting panel 100 may be improved.

In step S240, as shown in FIG. 19, the light-emitting element 112 and the second transistor T2 are electrically connected to the circuit layer 130 through the bonding pads PD. The light-emitting element 112 is electrically connected between the first power line PL1 and the second power line PL2. A second terminal D1 of the first transistor T1 is electrically connected to a control terminal G2 of the second transistor T2. The first terminal S2 of the second transistor T2 is electrically connected to one of the first power line PL1 and the second power line PL2. The second terminal D2 of the second transistor T2 is electrically connected to the light-emitting element 112. So far, the light-emitting panel 100 is obtained.

In a light-emitting panel 100 provided by the present disclosure, at least one light-emitting element 112 of each light-emitting unit 110 is electrically connected between the first power line PL1 and the second power line PL2. As such, the light-emitting element may be driven to light by electric current. A light-emission control module 111 is electrically connected to the light-emitting element 112 for controlling brightness of the light-emitting element 112. The light-emission control module 111 includes a first transistor T1 and a second transistor T2. When receiving the scan signal SS of the scan line SL and gated on, the first transistor T1 may transmit the data signal DS of the data line DL to the control terminal G2 of the second transistor T2. The data signal DS is a pulse width modulation signal. According to the data signal DS, the second transistor T2 may control the electric current flowing through the light-emitting element 112. In this way, brightness control of the light-emitting elements 112 in the light-emitting unit 110 may be realized, that is, regional brightness control of the light-emitting panel 100 may be realized. Accordingly, contrast of the light-emitting panel 100 when used for displaying images may be increased, and image displaying quality of a display device including the light-emitting panel 100 may be improved.

In a fabricating process of the light-emitting panel 100, a process of forming the second transistor T2 and the light-emitting element 112 may not be included in a process of forming the circuit layer 130 on the substrate. After the process of forming the circuit layer 130 is completed, prefabricated the second transistor T2 and light-emitting element 112 may connected to the bonding pads PD by bond binding. Steps of prefabricating the second transistor T2 and the light-emitting element 112 may be performed separately from the step of forming the circuit layer 130 on the substrate 120, or even at a same time. Alternatively, the second transistor T2 and the light-emitting element 112 may be provided directly from incoming supplies, and thus the fabricating efficiency of the light-emitting panel 100 may be further improved.

In the above configuration, the second transistor T2 is an external FET. The second transistor T2 and the light-emitting element 112 are connected between the first power line PL1 and the second power line PL2. That is, the second transistor T2 and the light-emitting element 112 are arranged between current sources. Accordingly, the second transistor T2 may generate power consumption, and the power consumption may be useless for a light-emitting function of the light-emitting panel 100. On-resistance of the second transistor T2 may have an influence on the power consumption. In one embodiment, the second transistor T2 is an FET, and the channel material of the second transistor T2 is usually polysilicon, and thus the on-resistance may be small (the on-resistance is usually in an order of several ohms). Accordingly, the power consumption of the second transistor T2 may be kept small, and thus the useless power consumption and overall power consumption of the light-emitting panel may be reduced. In one embodiment, the first transistor T1 is a TFT, and at least a portion of a structure of the first transistor T1 and the at least one wire layer 131 are arranged on a same layer. Accordingly, the at least the portion of the structure of the first transistor T1 may be fabricated while the wire layer 131 is formed. Thus, use of prefabricated first transistor T1 may be saved, and the production cost of the light-emitting panel 100 may be reduced. Though a mobility of the first transistor T1 in a TFT form may be lower than a mobility of the first transistor T1 in a prefabricated form, and on-resistance of the first transistor T1 in a TFT may be larger (the on-resistance is usually on an order of several kiloohms), the first transistor T1 may not be arranged between current sources. Accordingly, the first transistor T1 may have almost no useless power consumption in the light-emitting panel 100, and thus the luminous efficiency of the light-emitting panel 100 may not be adversely affected.

In one embodiment, the fabricating method of the light-emitting panel also includes providing a first resistor R1 and/or a second resistor R2, and electrically connecting the first resistor R1 and/or the second resistor R2 to the circuit layer 130 through the bonding pads PD. The first resistor R1 is electrically connected between the first power line PL1 and the second power line PL2. The second resistor R2 is electrically connected between the second terminal D1 of the first transistor T1 and the control terminal G2 of the second transistor T2. In some embodiments, a step of electrically connecting the first resistor R1 and/or the second resistor R2 to the circuit layer 130 through the bonding pads PD may be performed at a same time as the step S130. Fabricating efficiency of the light-emitting panel may thus be improved.

In one embodiment, the fabricating method of the light-emitting panel also includes forming the first resistor R1 and/or the second resistor R2 at a same time as step S120. That is, the first resistor R1 and/or the second resistor R2 and the at least one wire layer 131 are arranged on a same layer. A fabricating cost of the light-emitting panel 100 may thus be reduced.

An integration method of the first resistor R1 and the second resistor R2 with other components of the light-emitting panel 100 may be selected according to actual design requirements. For example, in one embodiment, the first resistor R1 is arranged on a same layer as the at least one wire layer 131. The second resistor R2 is an external prefabricated element. After step S220 and step S230, the second resistor R2 may be electrically connected to the circuit layer 130 through the bonding pads PD.

The first resistor R1 is a current limiting resistor. By setting the first resistor R1, the current flowing through the light-emitting element 112 may be limited within a set current range. Accordingly, the current flowing through the light-emitting element 112 may not change significantly with fluctuation of the first power signal PVDD, and thus a service life of the light-emitting element 112 may be increased. The second resistor R2 is a damping resistor. By setting the second resistor R2, influence of a parasitic capacitance of the gate (control terminal G2) of the second transistor T2 on the data signal DS may be eliminated, and stability of signal transmission may thus be improved.

The present disclosure also provides a driving method of a light-emitting panel. The driving method may be used for driving a light-emitting panel 100 provided in the present disclosure to emit light. In some embodiments, the driving method of the light-emitting panel includes providing scan signals SS to the light-emission control modules 111 corresponding to the light-emitting units 110 through a plurality of scan lines SL. The scan signal SS may be used to gate on the first transistors T1 of the corresponding light-emission control modules 111. The method also includes providing data signals DS to the light-emission control modules 111 corresponding to the light-emitting units 110 through a plurality of data lines DL. The data signals DS may be pulse width modulation signals. According to the data signals DS, the second transistor T2 may control the electric current flowing through the light-emitting elements 112. In this way, brightness control of the light-emitting elements 112 in the light-emitting unit 110 may be realized, that is, regional brightness control of the light-emitting panel 100 may be realized. Accordingly, contrast of the light-emitting panel 100 when used for displaying images may be increased, and image displaying quality of a display device including the light-emitting panel 100 may be improved.

In one embodiment, providing scan signals SS to the light-emission control modules 111 corresponding to the light-emitting units 110 through the plurality of scan lines SL includes, in a frame of time, providing scan signals SS that may turn on the scan lines SL in the second direction Y one by one. When the scan signals SS gate on a first transistor T1 corresponding to the light-emitting unit 110, the light-emission control module 111 may receive a corresponding data signal DS. The scan lines SL may be turned on one by one in the second direction Y. Accordingly, compared to ordinary high-speed scanning signals, by using the driving method provided by the present disclosure, the data signals DS and the scan signals SS may have a better display matching mode, and a better display effect may thus be achieved. Moreover, according to the driving method provided by the present disclosure, visual fatigue caused by low-frequency PWM dimming of a conventional light-emitting panel may be eliminated, and the display effect may thus be improved.

In one embodiment, providing data signals DS to the light-emission control modules 111 corresponding to the light-emitting units 110 through a plurality of data lines DL includes adjusting duty ratios of the data signals DS to control light-emitting brightness of the light-emitting elements 112. That is, for different gray levels, data signals DS with different duty ratios may be used to drive the light-emitting elements.

Figure 20:
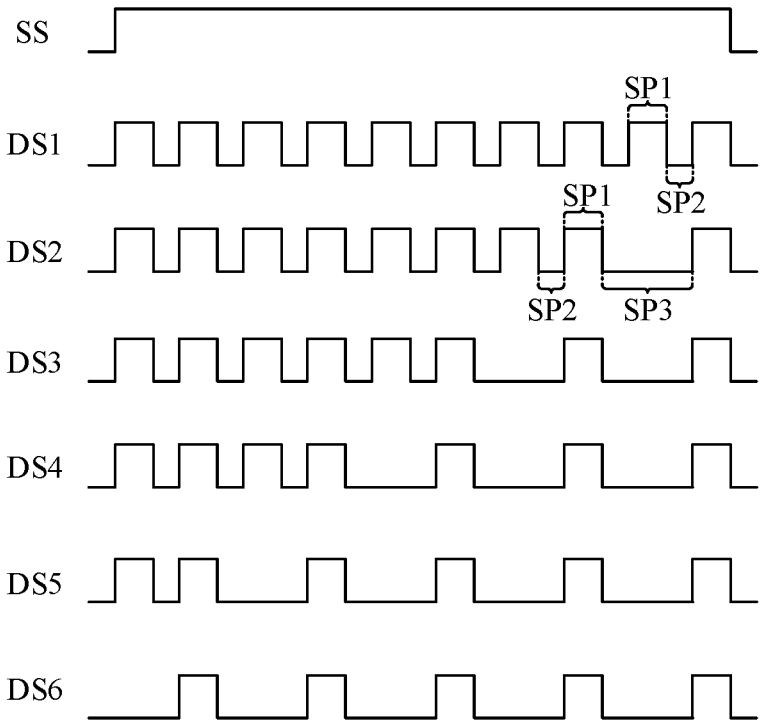
FIG. 20 illustrates a schematic of signals with various gray scales in a driving method of a light-emitting panel consistent with the disclosed embodiments of the present disclosure.

FIG. 20 illustrates a schematic of signals with various gray scales in a driving method of a light-emitting panel consistent with the disclosed embodiments of the present disclosure.

In one embodiment, the data signal DS includes a first grayscale signal DS1 and a second grayscale signal DS2. The first grayscale signal DS1 and the second grayscale signal DS2 are data signals DS of adjacent gray scales when a corresponding light-emitting element 112 emits light.

The first grayscale signal DS1 includes a plurality of first signal segments SP1 and a plurality of second signal segments SP2. The first signal segment SP1 and the second signal segment SP2 have different electric levels, and adjacent first signal segments SP1 are spaced by a second signal segment SP2. In one embodiment, the first signal segment SP1 is at a high electric level, and the second signal segment SP2 is at a low electric level.

The second grayscale signal DS2 includes a plurality of first signal segments SP1, at least one second signal segment SP2 and at least one third signal segment SP3. The third signal segment SP3 and the second signal segment SP2 may have a same electric level. A signal length of a third signal segment SP3 is equal to a sum of a signal length of one first signal segment SP1 and a signal length of two second signal segments SP2.

In the present disclosure, the data signal DS is not limited to include two grayscale signals only. FIG. 20 exemplarily shows first grayscale signal DS1 to sixth grayscale signal DS6, corresponding to six adjacent gray levels respectively. In a period when the first transistor T1 is gated on, the data signal DS (each grayscale signal) received by the light-emission control module 111 includes a plurality of first-level signal segments and a plurality of second-level signal segments, and adjacent first-level signal segments are spaced by a second-level signal segment. In one embodiment, the first level signal segment is a high electric level signal segment, and the second level signal segment is a low electric level signal segment. Each first-level signal segment has a same signal length, and the number of types of second-level signal segments may be less than or equal to two. Different types of second-level signal segments may have different signal lengths. In one embodiment, the data signals DS include two types of second-level signal segments. In the two types of second-level signal segments, the signal length of one type of second-level signal segment is equal to a sum of two times of the signal length of the other second-level signal segment and the signal length of the first-level signal segment. As shown in FIG. 20, for example, the first grayscale signal DS1 includes one type of the second-level signal segment, each of the second grayscale signal DS2 to the fifth grayscale signal DS5 includes two types of second-level signal segments, and the sixth grayscale signal DS6 includes one type of second-level signal segments.

Each grayscale signal of the data signal DS may be divided into a plurality of sub-blocks of specific values, and each sub-block has only one high electric level. The sub-blocks in the data signal DS may be reduced or increased by a space insertion way to achieve a smooth transition of gray levels, and thus flickering may be avoided when the light-emitting panel emits light.

The present disclosure also provides a display device. The display device includes a light-emitting panel 100 provided by the present disclosure.

In some embodiments, the display device may be a liquid crystal display (LCD). The display device includes a backlight module and a first display panel. The first display panel is located on a light-existing side of the backlight module. The backlight module includes a backlight source, a light guide plate, and a plurality of optical films such as diffusion sheets and prism sheets. In the display device, the backlight source includes a light-emitting panel 100 provided by the present disclosure.

In the display panel provided by the present disclosure, the backlight source includes a light-emitting panel 100. The light-emitting panel 100 includes light-emitting units 110 arranged in an array. For example, when the light-emitting units 110 are arranged in M rows and N columns, the number of the light-emitting units 110 is M×N. In a conventional solution, each light-emitting unit 110 receives a data signal DS through a signal line to achieve independent brightness control of each light-emitting unit 110, and thus a total of M×N signal lines for brightness control are required. In the present disclosure, the light-emitting panel 100 includes data lines DL arranged in the first direction X and scan lines SL arranged in the second direction Y. Each data line DL is electrically connected to the light-emission control modules 111 of the light-emitting units 110 arranged in the second direction Y. Each scan line SL is electrically connected to the light-emission control modules 111 of the light-emitting units 110 arranged in the first direction X. A total number of the scan lines SL and the data lines DL is M+N. Accordingly, in the present disclosure, the light-emitting panel 100 may use a smaller number of signal lines (M+N) to realize a regional brightness control of the light-emitting units 110 (each light-emitting unit 110 is a region). In a same wiring space, with a same number of signal lines, brightness control of a larger number of light-emitting units 110 may be achieved. Accordingly, the number of regions may be increased, and multi-zone dynamic backlight of the display device may be realized.

In some embodiments, the display device may be a self-luminous display device. The display device may include a second display panel. In the display device, the second display panel includes a light-emitting panel 100 provided by the present disclosure. The display device may be a mini-LED display device or a Micro-LED display device.

In the display device provided by the present disclosure, in a same wiring space, with a same number of signal lines, brightness control of a larger number of light-emitting units 110 may be achieved. Accordingly, a pixel density of the display device may be improved, and thus the display effect may be improved.

In a display device provided by the present disclosure, at least one light-emitting element 112 of each light-emitting unit 110 is electrically connected between the first power line PL1 and the second power line PL2. As such, the light-emitting element may be driven to light by electric current. A light-emission control module 111 is electrically connected to the light-emitting element 112 for controlling brightness of the light-emitting element 112. The light-emission control module 111 includes a first transistor T1 and a second transistor T2. When receiving the scan signal SS of the scan line SL and gated on, the first transistor T1 may transmit the data signal DS of the data line DL to the control terminal G2 of the second transistor T2. The data signal DS is a pulse width modulation signal. According to the data signal DS, the second transistor T2 may control the electric current flowing through the light-emitting element 112. In this way, brightness control of the light-emitting elements 112 in the light-emitting unit 110 may be realized, that is, regional brightness control of the light-emitting panel 100 may be realized. Accordingly, contrast of the light-emitting panel 100 when used for displaying images may be increased, and image displaying quality of a display device including the light-emitting panel 100 may be improved.

As disclosed, the technical solutions of the present disclosure have the following advantages.

The light-emitting panel provided by the present disclosure includes light-emitting units arranged in an array. For example, when the light-emitting units are arranged in M rows and N columns, the number of the light-emitting units 110 is M×N. In a conventional solution, each light-emitting unit receives a data signal DS through a signal line to achieve independent brightness control of each light-emitting unit, and thus a total of M×N signal lines for brightness control are required. In the present disclosure, the light-emitting panel includes data lines arranged in a first direction and scan lines arranged in a second direction. Each data line is electrically connected to the light-emission control modules of the light-emitting units arranged in the second direction. Each scan line is electrically connected to the light-emission control modules of the light-emitting units arranged in the first direction. A total number of the scan lines and the data lines is M+N. Accordingly, in the present disclosure, the light-emitting panel may use a smaller number of signal lines (M+N) to realize a regional brightness control of the light-emitting units (each light-emitting unit is a region). In a same wiring space, with a same number of signal lines, brightness control of a larger number of light-emitting units may be achieved, and the number of regions may thus be increased.

At least one light-emitting element of each light-emitting unit is electrically connected between the first power line and the second power line. As such, the light-emitting element may be driven to light by electric current. A light-emission control module is electrically connected to the light-emitting element for controlling brightness of the light-emitting element. The light-emission control module includes a first transistor and a second transistor. When receiving the scan signal of the scan line and gated on, the first transistor may transmit the data signal of the data line to the control terminal of the second transistor. The data signal is a pulse width modulation signal. According to the data signal, the second transistor may control the electric current flowing through the light-emitting element. In this way, brightness control of the light-emitting elements in the light-emitting unit may be realized, that is, regional brightness control of the light-emitting panel may be realized. Accordingly, contrast of the light-emitting panel when used for displaying images may be increased, and image displaying quality of a display device including the light-emitting panel may be improved.

The embodiments disclosed herein are exemplary only and not limiting the scope of this disclosure. Various combinations, alternations, modifications, equivalents, or improvements to the technical solutions of the disclosed embodiments can be obvious to those skilled in the art. Without departing from the spirit and scope of this disclosure, such combinations, alternations, modifications, equivalents, or improvements to the disclosed embodiments are intended to be encompassed within the scope of the present disclosure.

What is claimed is:

1. A light-emitting panel, comprising:

a substrate;

a circuit layer on the substrate, wherein the circuit layer includes at least one wire layer and a bonding layer on a side of the at least one wire layer away from the substrate, and the bonding layer includes a bonding pad electrically connected to the at least one wire layer;

a plurality of light-emitting units arranged in an array, wherein each of the plurality of light-emitting units includes a light-emission control module and at least one light-emitting element, and the at least one light-emitting element is electrically connected to the light-emission control module;

a plurality of data lines arranged in a first direction, wherein each of the plurality of data lines is electrically connected to light-emission control modules of light-emitting units that are arranged in a second direction, and the second direction intersects the first direction;

a plurality of scan lines arranged in the second direction, wherein each of the plurality of scan lines is electrically connected to light-emission control modules of light-emitting units that are arranged in the first direction; and a first power line and a second power line, wherein:

the at least one light-emitting element of each light-emitting unit is electrically connected between the first power line and the second power line;

the light-emission control module includes a first transistor and a second transistor;

a first terminal of the first transistor is electrically connected to the data line, a second terminal of the first transistor is electrically connected to a control terminal of the second transistor, and a control terminal of the first transistor is electrically connected to the scan line;

a first terminal of the second transistor is electrically connected to one of the first power line and the second power line, and a second terminal of the second transistor is electrically connected to the at least one light-emitting element;

the light-emission control module receives a data signal through the data line, and the data signal is a pulse width modulation signal;

at least one of the plurality of data lines, the plurality of scan lines, the first power line, or the second power line is arranged on the at least one wire layer; and the at least one light-emitting element and the second transistor are electrically connected to the at least one wire layer through the bonding pad, respectively.

2. The light-emitting panel according to claim 1, wherein:

the first transistor is electrically connected to the at least one wire layer through the bonding pad.

3. The light-emitting panel according to claim 1, wherein:

the first transistor is a thin film transistor;

at least a portion of a structure of the first transistor and the at least one wire layer are arranged on a same layer;

the control terminal of the first transistor and the plurality of scan lines are arranged on a same layer; and the first terminal and the second terminal of the first transistor and the plurality of data line are arranged on a same layer.

4. The light-emitting panel according to claim 1, wherein:

the first power line and the plurality of scan lines are arranged on the at least one wire layer; and the first power line and the plurality of scan lines are arranged on a same layer.

5. The light-emitting panel according to claim 1, wherein:

at least one of the plurality of data lines, the plurality of scan lines, the first power line, or the second power line is arranged on the bonding layer.

6. The light-emitting panel according to claim 1, wherein:

each light-emitting unit also includes a first resistor; and the first resistor is electrically connected between the first power line and the second power line.

7. The light-emitting panel according to claim 6, wherein:

the first resistor is electrically connected to the at least one wire layer through the bonding pad; or the first resistor and the at least one wire layer are arranged on a same layer.

8. The light-emitting panel according to claim 7, wherein:

a resistance of the first resistor is less than or equal to approximately 100 ohms.

9. The light-emitting panel according to claim 1, wherein:

the light-emission control module further includes a second resistor, and the second resistor is electrically connected between the second terminal of the first transistor and the control terminal of the second transistor.

10. The light-emitting panel according to claim 9, wherein:

the second resistor is electrically connected to the at least one wire layer through the bonding pad; or the second resistor and the at least one wire layer is arranged on a same layer.

11. The light-emitting panel according to claim 1, further comprising:

a gate driving circuit, located on at least one side of the plurality of light-emitting units in the first direction, wherein the plurality of scan lines is electrically connected to the gate driving circuit; and a data driving circuit, located on at least one side of the plurality of light-emitting units in the second direction, wherein the plurality of data lines, the first power line and the second power line are electrically connected to the data driving circuit.

12. The light-emitting panel according to claim 1, wherein:

the second transistor is a field-effect transistor.

13. The light-emitting panel according to claim 1, wherein:

the at least one light-emitting element receives a first power supply signal through the first power line;

the at least one light-emitting element receives a second power supply signal through the second power line; and both the first power supply signal and the second power supply signal are DC signals.

14. A driving method of the light-emitting panel according to claim 1, comprising:

providing scan signals to the light-emission control modules corresponding to the light-emitting units through the plurality of scan lines, wherein the scan signals are used to gate on the first transistors corresponding to the light-emission control modules; and providing data signals to the light-emission control modules corresponding to the light-emitting units through the plurality of data lines, wherein the data signals are pulse width modulation signals.

15. The driving method according to claim 14, wherein providing the scan signals to the light-emission control modules corresponding to the light-emitting units through the plurality of scan lines includes:

in a frame of time, the plurality of scan lines is provided with scan signals one by one in the second direction.

16. The driving method according to claim 14, wherein providing the data signals to the light-emission control modules corresponding to the light-emitting units through the plurality of data lines includes:

adjusting pulse widths of the pulse width modulation signals to control light-emitting brightness of the at least one light-emitting element.

17. A fabricating method of a light-emitting panel, comprising:

providing a substrate, a first transistor, a second transistor, and a light-emitting element;

forming at least one wire layer and a bonding layer on the substrate, thereby forming a circuit layer, wherein the bonding layer includes a bonding pad electrically connected to the at least one wire layer, and forming the circuit layer includes forming a plurality of data lines, a plurality of scan lines, a first power line, and a second power line; and electrically connecting the light-emitting element, the first transistor, and the second transistor to the circuit layer through the bonding pad, wherein:

the light-emitting element is electrically connected between the first power line and the second power line;

a first terminal of the first transistor is electrically connected to a data line of the plurality of data lines;

a second terminal of the first transistor is electrically connected to a control terminal of the second transistor;

a control terminal of the first transistor is electrically connected to a scan line of the plurality of scan lines;

a first terminal of the second transistor is electrically connected to one of the first power line and the second power line; and a second terminal of the second transistor is electrically connected to the light-emitting element.

18. The fabricating method according to claim 17, further comprising:

providing a first resistor and/or a second resistor; and electrically connecting the first resistor and/or the second resistor to the circuit layer through the bonding pad, wherein the first resistor is electrically connected between the first power line and the second power line, and/or the second resistor is electrically connected between the second terminal of the first transistor and the control terminal of the second transistor.

19. A fabricating method of a light-emitting panel, comprising:

providing a substrate, a second transistor, and a light-emitting element;

forming at least one wire layer and a bonding layer on the substrate, thereby forming a circuit layer, wherein the bonding layer includes a bonding pad electrically connected to the at least one wire layer, and forming the circuit layer includes forming a plurality of data lines, a plurality of scan lines, a first power line, and a second power line;

forming a first transistor on the substrate, wherein at least a portion of a structure of the first transistor is arranged in a same layer as the at least one wire layer, a first terminal of the first transistor is electrically connected to a data line of the plurality of data lines, and a control terminal of the first transistor is electrically connected to a scan line of the plurality of scan lines; and electrically connecting the light-emitting element and the second transistor to the circuit layer through the bonding pad, wherein the light-emitting element is electrically connected between the first power line and the second power line, a second terminal of the first transistor is electrically connected to a control terminal of the second transistor, a first terminal of the second transistor is electrically connected to one of the first power line and the second power line, and a second terminal of the second transistor is electrically connected to the light-emitting element.

* * * * *